US008016146B2

(12) United States Patent
Rekstad

(10) Patent No.: US 8,016,146 B2
(45) Date of Patent: Sep. 13, 2011

(54) SPILL RESISTANT CAPS AND CONTAINER SYSTEMS

(76) Inventor: Stephen S. Rekstad, Eden Prairie, MN (US)

( * ) Notice: Subject to any disclaimer, the term of this patent is extended or adjusted under 35 U.S.C. 154(b) by 368 days.

(21) Appl. No.: 12/181,806

(22) Filed: Jul. 29, 2008

(65) Prior Publication Data

US 2009/0032487 A1 Feb. 5, 2009

Related U.S. Application Data

(60) Provisional application No. 60/962,415, filed on Jul. 30, 2007.

(51) Int. Cl.
*B65D 51/16* (2006.01)
*B65D 83/00* (2006.01)

(52) U.S. Cl. ..... 220/203.11; 220/714; 220/717; 215/260; 215/270; 215/309; 215/387; 215/388

(58) Field of Classification Search ..... 220/203.11, 220/714, 717; 215/260, 270, 309, 387, 388
See application file for complete search history.

(56) References Cited

U.S. PATENT DOCUMENTS

| | | | | |
|---|---|---|---|---|
| 5,873,478 | A | 2/1999 | Sullivan et al. | |
| 5,988,425 | A | 11/1999 | Yehl et al. | |
| 6,092,551 | A | 7/2000 | Bennett | |
| 6,305,570 | B1 * | 10/2001 | Atkin et al. | 220/714 |
| 6,568,557 | B2 | 5/2003 | Fusco et al. | |
| 6,745,915 | B2 | 6/2004 | Rees | |
| 6,877,626 | B2 | 4/2005 | Sherrod | |
| 7,222,643 | B2 | 5/2007 | Bailey | |
| 7,225,829 | B2 | 6/2007 | Bailey | |
| 7,243,676 | B2 | 7/2007 | Bailey | |
| 7,302,971 | B2 | 12/2007 | Myntti | |
| 2007/0062906 | A1 | 3/2007 | Morano et al. | |
| 2007/0068893 | A1 | 3/2007 | Eidson | |
| 2007/0145060 | A1 | 6/2007 | Connors, Jr. et al. | |

* cited by examiner

*Primary Examiner* — Anthony Stashick
*Assistant Examiner* — Madison L Wright
(74) *Attorney, Agent, or Firm* — Shumaker & Sieffert, P.A.

(57) ABSTRACT

A spill resistant cap for a container, such as a commercially available water or other beverage bottle, includes a cap body that forms a mating fit with the container and a spout having liquid dispense holes that allow fluid to flow out of the container. A removable valve is sized to fit within the cap body. The valve includes a valve mechanism that opens in response to a pressure differential applied across the valve face, such as the mouth suction applied to the spout when a person attempts to drink from the container, allowing fluid to flow through the valve and through the liquid dispense holes in the spout.

11 Claims, 5 Drawing Sheets

SPILL RESISTANT CAPS AND CONTAINER SYSTEMS

CROSS REFERENCE TO RELATED APPLICATIONS

This application claims the benefit of U.S. Provisional Application No. 60/962,415, filed Jul. 30, 2007, the entire contents of which are incorporated herein by reference.

TECHNICAL FIELD

The present invention relates generally to the field of spill resistant containers and caps, such as for beverages or other liquids.

BACKGROUND

Commercially available bottled water and juice are very popular in today's society. These bottles are typically available with threaded, twist off type caps. Some commercially available beverage bottles, in an effort to make them spill resistant, come with caps in which a mechanical movement permits the cap to alternate between an open and closed position. One such cap is the familiar pop-up spout that opens when the spout is pulled up and that closes when the spout is pressed down. Other such caps are twisted in one direction to open and twisted in the opposite direction to close.

In addition, many styles of spill resistant cups designed for children, otherwise known as "sippy cups," are available today. Such spill resistant cups typically include a matched cup and spill resistant cap, in which the cap is designed to snap or thread onto the cup. The cap usually incorporates a spout and some type of valve to reduce or inhibit spillage when a child drinks from the cup.

SUMMARY

The present invention provides a spill resistant container system including a valved spill resistant cap and a standard commercially available beverage bottle, such as those typically containing water, milk, juice, soda or other beverage. The cap is shaped to accommodate a user's mouth and includes a valve to inhibit spillage of the liquid through the cap.

In one embodiment, the invention is directed to a spill resistant cap for a container, comprising a cap body that forms a mating fit with the container and including a spout having liquid dispense holes that allow fluid to flow out of the container and a removable valve sized to fit within the cap body, the valve comprising a fluid flow lumen extending from a inlet end to an outlet end, a valve face covering the outlet end of the fluid flow lumen, and a valve mechanism that opens in response to a pressure differential applied across the valve face, such that when suction is applied to the spout, the valve mechanism opens and fluid flows through the lumen through the outlet side of the valve face and through the liquid dispense holes. The valve may include a base at an inlet end of the valve, a second stepped-down side wall having a valve face at an outlet end of the valve, a first stepped-down side wall connected between the base and the second stepped-down side wall and having a diameter relatively smaller than a diameter of the base and relatively larger than a diameter of the second stepped-down side wall, and a circumferential outer rim connected between the base and the first stepped-down side wall. The cap body may include a pressure relief bore, and the circumferential outer rim may include a tab-shaped extension that covers the pressure relief bore when no fluid is being dispensed and that flexes back to allow air to enter the container through the pressure release bore during dispensing of the fluid.

In another embodiment, the invention is directed to a kit comprising a plurality of spill resistant caps, each spill resistant cap comprising a cap body, the cap body comprising a spout having liquid dispense holes that allow fluid to flow out of the container, and one of a plurality of engagement mechanisms that permit the cap body to engage with the container, and a removable valve sized to fit within the cap body, the valve comprising a fluid flow lumen extending from a inlet end to an outlet end, a valve face covering the outlet end of the fluid flow lumen, and a valve mechanism that opens in response to a pressure differential applied across the valve face, such that when suction is applied to the spout, the valve mechanism opens and fluid flows through the lumen through the outlet side of the valve face and through the liquid dispense holes, the plurality of spill resistant caps including a first spill resistant cap having a first sized threaded engagement mechanism and a second spill resistant cap having a second, differently sized threaded engagement mechanism.

In another embodiment, the invention is directed to a spill resistant container system, comprising a container that holds a fluid, a spill resistant cap that includes a cap body, the cap body including a spout having liquid dispense holes that allow fluid to flow out of the container, and one of a plurality of engagement mechanisms integral with the cap body that permit the cap body to engage with the container, and a removable valve sized to fit within the cap body, the valve including a fluid flow lumen extending from a inlet end to an outlet end, a valve face covering the outlet end of the fluid flow lumen, and a valve mechanism that opens in response to a pressure differential applied across the valve face, such that when suction is applied to the spout, the valve mechanism opens and fluid flows through the lumen through the outlet side of the valve face and through the liquid dispense holes.

The details of one or more embodiments of the invention are set forth in the accompanying drawings and the description below. Other features and advantages of the invention will be apparent from the description and drawings, and from the claims.

DETAILED DESCRIPTION

Commercially available bottled beverages are very popular in today's society. The present invention provides spill resistant caps and container systems for use with commercially available beverage containers, such as water, juice, sports drink, soft drink or other commercially available bottled beverages.

Figure 1:
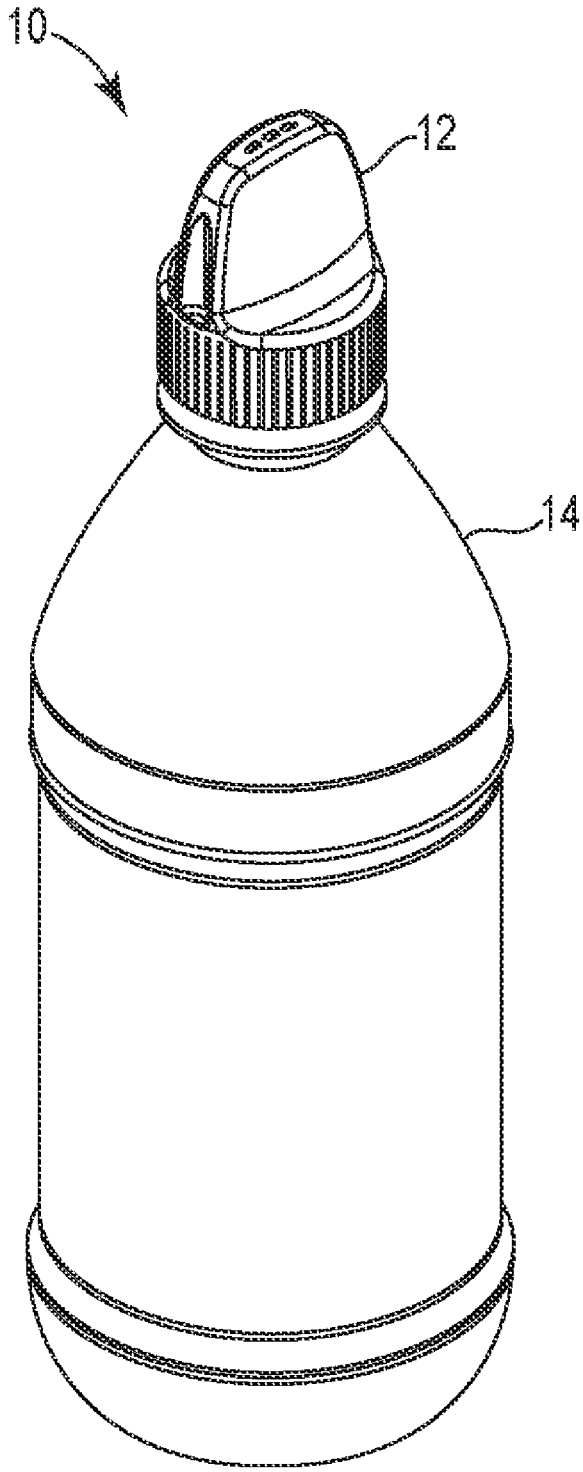
FIG. 1 is perspective view of an example spill resistant cap and container system of the present invention.

FIG. 1 is a perspective view of an example of a spill resistant cap and container system 10 of the present invention. System 10 generally includes a container 14 and a spill resistant cap 12. Container 14 may be any commercially available container or bottle such as those in which water, milk, juice, sports drink, soda or other beverage are commonly sold. Container 14 may also be any other type of bottle or vessel designed to contain a liquid, gel or other viscous substance.

For simplicity of illustration, system 10 will be generally described herein as a spill resistant beverage container system. The system may be useful, for example, for use by children who are generally unable to drink a standard commercially available bottled beverage without spilling or choking or in other applications, such as sports or other activities where a spill resistant beverage drinking container is desired. However, it shall be understood that spill resistant container system 10, or spill resistant cap 12, may also be used in other applications in which a reduction or elimination of spillage of a liquid or other viscous substance is desired.

Figure 2:
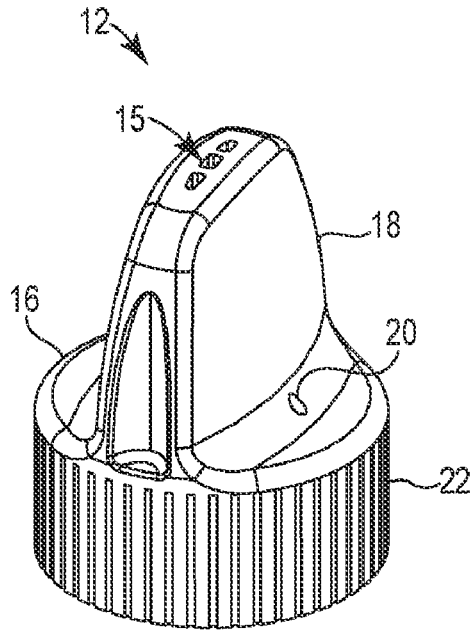
FIG. 2 is a perspective view of an example spill resistant cap.

FIG. 2 is a perspective view of one example of a spill resistant cap 12. In general, spill resistant cap 12 includes a cap body 16 and an internal valve (not shown in FIG. 2) that controls flow of liquid through cap 12. Cap body 16 may be designed to fit onto a standard commercially available bottle. For example, the interior rim of cap body may be threaded (see, e.g., FIG. 3) to mate with the threaded neck of a commercially available beverage bottle. Cap body 16 includes a spout 18 generally shaped to accommodate a user's mouth. Spout 18 may be generally elliptically or circularly shaped; however, it shall be understood that spout 18 may take any desired shape, and that the invention is not limited in this respect. Cap body 16 further includes liquid dispense holes 15 that allow fluid to flow out of container 14. Liquid dispense holes 15 may be sized to limit fluid flow out of the container to any extent desired. For example, when spill resistant cap 12 is to be used by young children, liquid dispense holes 15 may be relatively small to limit fluid flow and/or to reduce the possibility of choking. However, it shall be understood that liquid dispense holes 15 may be any suitable size, and the invention is not limited in this respect. Cap body 16 may also include a pressure relief lumen 20, in this case a bore through cap body 16, which vents the interior of container 14 during dispensing of the liquid. An outer side wall 22 may be ridged to allow a user's hands to grip cap 12 during twisting onto or off of container 14.

Figure 3:
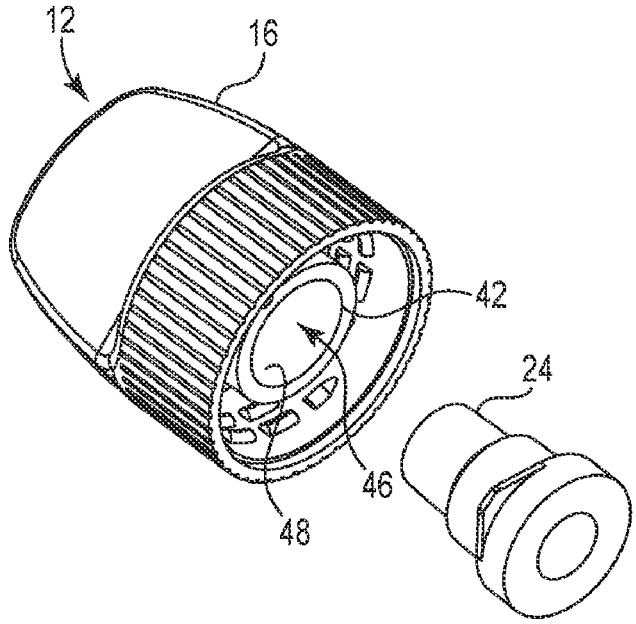
FIG. 3 is a bottom perspective view of an example spill resistant cap including a cap body and a valve.

FIG. 3 is a bottom perspective view of an example spill resistant cap 12 of the present invention, including an example cap body 16 and an example valve 24. Cap body 16 includes a longitudinally extending lumen 46 having interior side walls 48 that are sized to accommodate valve 24. Cap body also includes an interior rim 42. In this example, valve 24 is inserted into lumen 46 of cap body 16 until valve 24 meets interior rim 42. Valve 24 is held in place by friction against interior side wall 48 of lumen 46. Valve 24 may be removable from cap body 16 to allow for cleaning or replacement.

Figure 4:
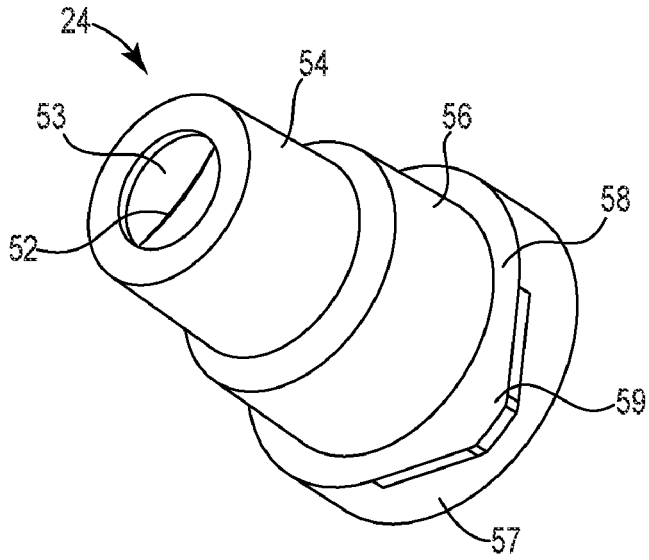
FIG. 4 is a top perspective view of an example spill resistant valve.
Figure 5:
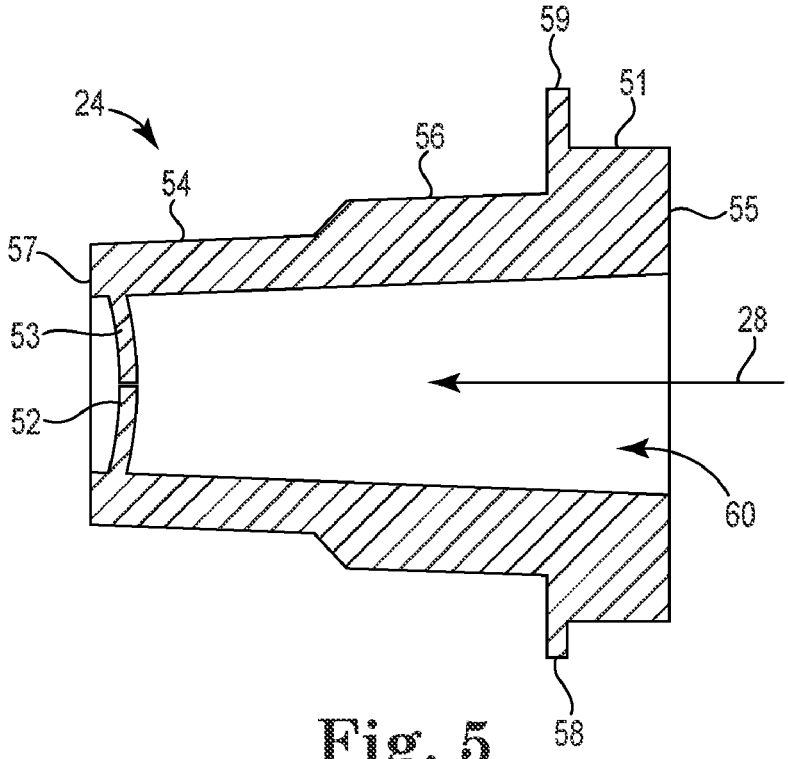
FIG. 5 is a cross-sectional side view of an example spill resistant valve.

FIGS. 4 and 5 are a top perspective view and a cross-sectional side view of an example valve 24, respectively. Valve 24 may be made from a flexible material, such as rubber, flexible plastic, synthetic elastomer, silicone, polyethylene, polypropylene, or other appropriate flexible material. In this example, valve 24 is generally cylindrical or circular in shape and includes a base 51 and two stepped-down side walls 56 and 54. The diameter of first stepped-down side wall 56 is generally sized to fit snugly within lumen 46 of cap body 16 such that valve 24 is held in place by friction between first stepped-down side wall 56 and cap body lumen 46. The diameter of base 51 is generally sized to be relatively larger than the diameter of interior rim 42 of cap body 16. The diameter of second stepped-down side wall 54 is relatively smaller than the diameter of cap body lumen 46

A circumferential outer rim 58 may also extend around the perimeter of valve 24. Circumferential outer rim 58 has a diameter that is relatively larger than the diameter of base 51. Circumferential outer rim 58 may include a tab-shaped extension 59 that facilitates grasping by a user to remove the valve from the cap body. Tab-shaped extension 59 may also cover pressure release lumen 20 to prevent leakage of the fluid from container 14 when the cap and container are not in use (e.g., when no one is drinking from the container). Tab-shaped extension 59 may also flex backward during dispensing of fluid from container 14 to allow air to enter container 14 and provide pressure equalization inside of the container. However, it shall be understood that valve 24 need not include such an extension, and that the invention is not limited in this respect.

Valve 24 includes an inlet end 55 and an outlet end 57. A valve lumen 60 extends from inlet end 55 to outlet end 57. In general, fluid from within container 14 travels through valve lumen 60 from the inlet end 55 of the valve through the outlet end 57 as indicated by arrow 28. A valve face 53 covers lumen 60 at outlet end 57. Valve face may include a thin membrane or other appropriate valve face material. Valve face 53 includes a valve mechanism 52 that allows fluid to pass through the valve 24 in the direction indicated by arrow 28 when suction is applied to spout 18. Valve mechanism 52 may include, for example, a slit, multiple slits, holes or other mechanism that allows fluid to pass through when suction is the applied to spout 18.

During use (e.g., when a user is drinking from the container) or when the container is otherwise in an inverted position, pressure provided by the weight of the fluid within container 14 helps to keep valve 24 in position within cap body 16.

In general, valve 24 opens in response to a pressure differential across the valve. For example, suction applied on the outlet side of the valve (the side from which the fluid exits the valve), such as the mouth suction applied when a person attempts to drink from the bottle, decreases the pressure on the outlet side of the valve, causing slit 52 to open and liquid to flow through. When not in use, slit 52 remains closed, thus closing the opening and preventing liquid from flowing through valve 24. The relatively smaller diameter of second stepped-down side wall 54 as compared to the diameter of cap body lumen 46 allows stepped-down side wall 54 to flex during opening and closing of slit 52.

Figure 6:
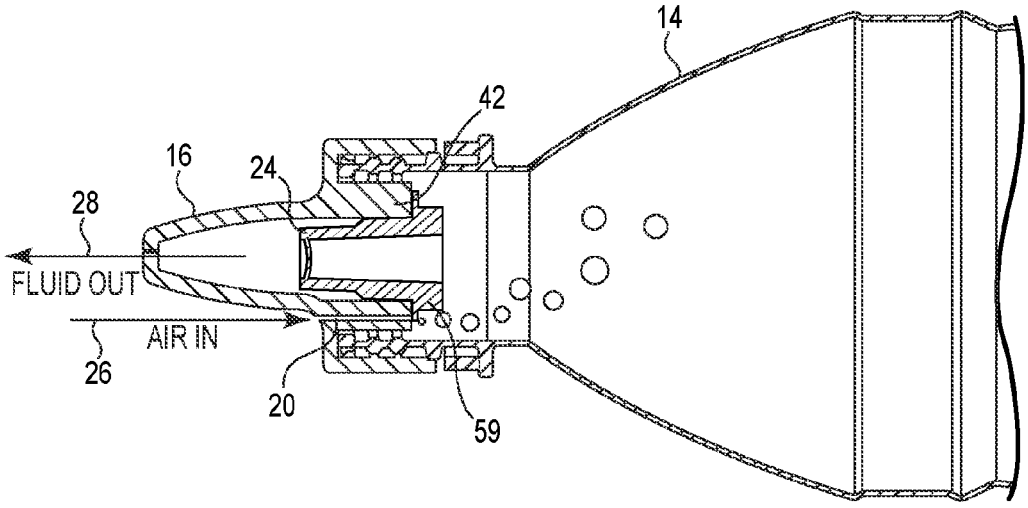
FIG. 6 is a cross-sectional side view of an example spill resistant cap and container system.

FIG. 6 is a cross-sectional side view of an example spill resistant cap and container system 10. Valve 24 is placed inside lumen 46 of cap body 16 until outer rim 58 of valve 24 meets interior rim 42 of cap body 16. Valve 24 is positioned such that tab-shaped extension 59 covers pressure release lumen 20 in cap body 16. In use, as pressure on the outlet side of valve 24 is decreased by suction of a user's mouth, slit 52 opens and permits liquid to pass through liquid dispense holes 15 in the direction indicated by arrow 28. At the same time, outer rim 58 of valve 24 flexes back to allow air to enter container 14 via pressure release lumen 20 in the direction indicated by arrow 26. In this example, valve 24 may be dual purpose in that it allows fluid to flow out of container 14 when suction is applied to cap body 16 and also allows ambient pressure equalization inside container 14.

Cap body 16 may be manufactured with any of several different cap diameters and/or thread dimensions to form a mating fit with a wide variety of commercially available beverage containers. Because the necks of commercially available beverage containers come in several sizes, from the relatively narrower neck of a standard commercially available water or soft drink bottle to the relatively wider neck of a commercially available milk, juice or sports drink bottle, the present invention may be designed to fit with any of these beverage containers without departing from the spirit and scope of the present invention. Also, although cap body 16 may be designed to connect with container 14 via mating threads, cap body 16 may also be designed to form a snap-fit, press-fit or other type of mating connection onto the container. Thus, it shall be understood that the invention is not limited in the manner in which the cap body 16 connects with container 14.

Figure 7A:
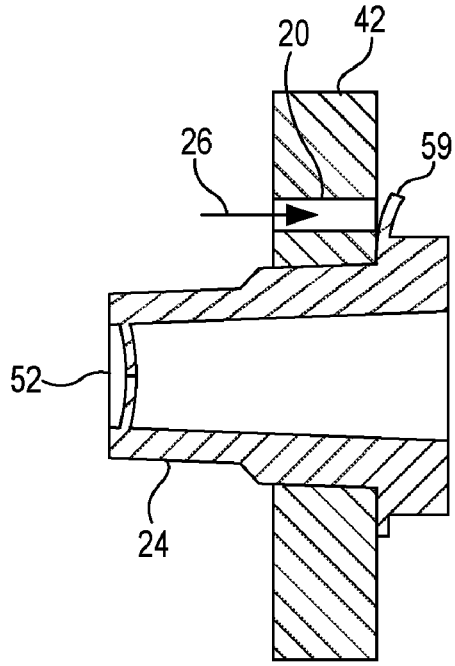
FIGS. 7A and 7B are cross-sectional side views of an example spill resistant valve.
Figure 7B:
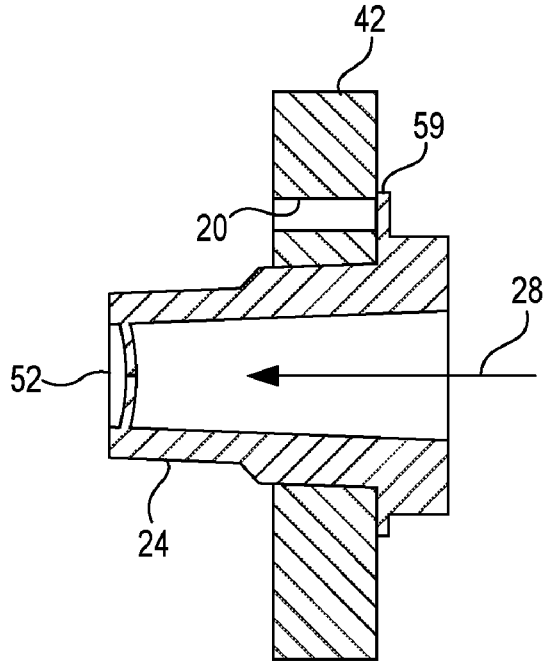

FIGS. 7A and 7B are cross-sectional side views showing a closer view of an example valve 24 within cap body interior rim 42. When no pressure differential is being applied (e.g., when no one is attempting to drink from container 14) tab-shaped extension 59 remains closed against an interior rim 43 to prevent fluid from leaking out through the pressure release lumen 20. When a pressure differential is applied across the outlet end of valve 24, such as when a person attempts to drink from the container and applies mouth suction to the spout, slit 52 at the outlet end opens to permit fluid to flow through the valve as shown in FIG. 7B. At the same time, tab-shaped extension 59 may flex back to allow air to enter the container through the pressure release bore as shown in FIG. 7A. When suction is no longer applied to the outlet side of valve 24, however, slit 52 closes, restricting fluid flow through the valve. Once the pressure inside of container 14 is equalized with the ambient air temperature, tab-shaped extension 59 returns to its flattened position covering pressure release lumen 20 to prevent leakage of fluid from container 14.

As stated above, spill resistant cap 12 includes a mechanism that engages with the container 14. Commercially available beverage bottles come in an array of different sized neck openings, as well as different mechanisms by which the cap engages with the container, including threads, ridges that allow the cap to snap-on, etc. Therefore, cap body 16 may include any one of a plurality of engagement mechanisms that allow the spill resistant cap to engage with a plurality of different sized bottle openings. The engagement mechanisms may include for example, threads, snap-on mechanisms, or other mechanism that permits a cap to engage with a container.

To facilitate use of the spill resistant cap with differently sized container openings and/or engagement mechanisms, a plurality of spill resistant caps, each designed to fit one of a plurality of commercially available beverage containers, may be sold together as a kit. For example, a package of spill resistant caps may be sold that includes multiple spill resistant caps, each having differently sized engagement mechanisms, or different types of engagement mechanisms. As another example, three spill resistant caps may be sold in one package, in which two of the spill resistant caps include differently sized threaded engagement mechanisms and the third cap includes a snap-on engagement mechanism, etc. By packaging spill resistant caps in this manner, a consumer may purchase in one package the spill resistant caps that fit the most commonly available beverage containers. It shall be readily apparent that differently sized or type of spill resistant caps may be sold separately or together in any of multiple combinations, and that the invention is not limited in this respect.

Various embodiments of the invention have been described. These and other embodiments are within the scope of the following claims.

The invention claimed is:

1. A spill resistant cap for a container, comprising:
- a cap body defining a longitudinally extending lumen, the cap body comprising:
  - a spout having liquid dispense holes that allow fluid to flow from the container during dispensing of the fluid;
  - an integral engagement mechanism that mechanically engages the cap body with the container; and
  - a pressure relief lumen that allows air to enter into the container during dispensing of the fluid; and
- a removable valve sized to fit within the cap body, the valve comprising:
  - a fluid flow lumen extending from an inlet end to an outlet end;
  - a valve face covering the outlet end of the fluid flow lumen;
  - a valve mechanism that opens in response to a pressure differential applied across the valve face, such that when suction is applied to the spout, the valve mechanism opens and fluid flows through the lumen through the outlet side of the valve face and through the liquid dispense holes;
  - a first stepped-down side wall sized to fit within a longitudinally extending lumen defined by the cap body;
  - a second stepped-down side wall at the outlet end of the valve and having an outer diameter relatively smaller than an inside diameter of the longitudinally extending lumen; and
  - a rim connected between a base and the first stepped-down side wall, the rim having a diameter relatively larger than the diameter of the first stepped-down side wall, the rim further including a tab-shaped extension that covers the pressure relief lumen when the valve is fit within the cap body and that flexes away from the pressure relief lumen to allow air to enter into the container through the pressure relief lumen during dispensing of the fluid.

2. The spill resistant cap of claim 1, wherein the valve comprises a flexible material.

3. The spill resistant cap of claim 1, wherein the valve comprises one of rubber, a flexible plastic, silicone, a synthetic elastomer, polyethylene or polypropylene.

4. The spill resistant cap of claim 1, wherein the valve face comprises a membrane and wherein valve mechanism comprises at least one slit in the membrane.

5. The spill resistant cap of claim 1, wherein the engagement mechanism includes one of threads or a snap-on mechanism.

6. The spill resistant cap of claim 1, the valve further comprising a base at the inlet end of the valve.

7. A kit, comprising:
- a plurality of spill resistant caps, each spill resistant cap comprising:
  - a cap body, the cap body comprising:
    - a spout having liquid dispense holes that allow fluid to flow from a container during dispensing of the fluid;
    - an engagement mechanism that permits the cap body to engage with the container; and
    - a pressure relief lumen that allows air to enter into the container during dispensing of the fluid; and
  - a removable valve, the valve comprising:
    - a fluid flow lumen extending from an inlet end of the valve to an outlet end of the valve;

a base at the inlet end of the valve;

a first valve section sized to fit within the cap body;

a second valve section including a valve mechanism at the outlet end of the valve and having a diameter relatively smaller than a diameter of the first valve section; and a rim connected between the base and the first valve section, the rim having a diameter relatively larger than the diameter of the first valve section and including an extension that covers the pressure relief lumen when the valve is fit within the cap body;

the plurality of spill resistant caps including a first spill resistant cap having a first sized threaded engagement mechanism and a second spill resistant cap having a second, differently sized threaded engagement mechanism.

8. The kit of claim 7, further including a third spill resistant cap having a snap-on engagement mechanism.

9. A spill resistant container system, comprising;

a container that holds a fluid;

a spill resistant cap, comprising:

a cap body defining a longitudinally extending lumen, the cap body comprising:

a spout having liquid dispense holes that allow fluid to flow from the container during dispensing of the fluid;

an engagement mechanism integral with the cap body that permits the cap body to engage with the container; and a pressure relief lumen that allows air to enter into the container during dispensing of the fluid; and a removable valve, the valve comprising:

a fluid flow lumen extending from an inlet end of the valve to an outlet end of the valve;

a base at the inlet end of the valve;

a first valve section sized to fit within the longitudinally extending lumen of the cap body;

a second valve section including a valve mechanism at the outlet end of the valve and having an outer diameter relatively smaller than an inside diameter of the longitudinally extending lumen of the cap body; and a rim connected between the base and the first valve section, the rim having a diameter relatively larger than the diameter of the first valve section and including a tab-shaped extension that covers the pressure relief lumen when the valve is fit within the longitudinally extending lumen of the cap body.

10. The spill resistant container system of claim 9 wherein the container is a commercially available beverage bottle.

11. A spill resistant cap for a container, comprising:

a cap body defining a longitudinally extending lumen, the cap body comprising:

a spout having liquid dispense holes that allow fluid to flow from the container;

an engagement mechanism that mechanically engages the cap body with the container; and a pressure relief lumen that allows air to enter into the container during dispensing of the fluid; and a removable valve, the valve comprising:

a fluid flow lumen extending from an inlet end of the valve to an outlet end of the valve;

a base at the inlet end of the valve;

a first valve section sized to fit within the longitudinally extending lumen of the cap body;

a second valve section including a valve mechanism at the outlet end of the valve and having an outer diameter relatively smaller than an inside diameter of the longitudinally extending lumen; and a rim extending around a perimeter of the valve between the base and the first valve section, the rim having a diameter relatively larger than the diameter of the first valve section and including a tab-shaped extension that covers the pressure relief lumen when the valve is fit within the longitudinally extending lumen of the cap body.

* * * * *